US007690156B2

(12) United States Patent
Imai et al.

(10) Patent No.: US 7,690,156 B2
(45) Date of Patent: Apr. 6, 2010

(54) DOOR OPENING/CLOSING CONTROL DEVICE

(75) Inventors: Takuya Imai, Yamanashi (JP); Tsunenori Senbongi, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 1078 days.

(21) Appl. No.: 11/312,531

(22) Filed: Dec. 21, 2005

(65) Prior Publication Data

US 2006/0137250 A1 Jun. 29, 2006

(30) Foreign Application Priority Data

Dec. 28, 2004 (JP) ..... 2004-379881

(51) Int. Cl.
*E05F 11/00* (2006.01)

(52) U.S. Cl. ..... 49/360; 296/155; 318/445

(58) Field of Classification Search ..... 49/360, 49/29, 30; 296/155; 318/609, 610, 264–267, 318/272, 277, 286, 466–469
See application file for complete search history.

(56) References Cited

U.S. PATENT DOCUMENTS 5,069,000 A * 12/1991 Zuckerman ..... 49/28
5,689,160 A * 11/1997 Shigematsu et al. ..... 318/281
5,977,732 A * 11/1999 Matsumoto ..... 318/283
6,054,822 A * 4/2000 Harada ..... 318/434
6,134,836 A * 10/2000 Kawanobe et al. ..... 49/360
6,164,015 A * 12/2000 Kawanobe et al. ..... 49/360
6,178,699 B1 * 1/2001 Kawanobe et al. ..... 49/360
6,183,040 B1 * 2/2001 Imaizumi et al. ..... 296/155
6,199,322 B1 * 3/2001 Itami et al. ..... 49/139
6,226,925 B1 * 5/2001 Shimura et al. ..... 49/360
6,274,947 B1 * 8/2001 Terashima ..... 307/10.1
6,430,875 B1 * 8/2002 Clark et al. ..... 49/360
6,525,499 B2 * 2/2003 Naganuma ..... 318/445
6,594,567 B2 * 7/2003 Zhou et al. ..... 701/36
6,659,539 B2 * 12/2003 Yogo et al. ..... 296/155
6,729,071 B1 * 5/2004 Kawanobe et al. ..... 49/360
6,814,394 B2 * 11/2004 Yogo et al. ..... 296/155
6,926,342 B2 * 8/2005 Pommeret et al. ..... 296/155
7,073,291 B2 * 7/2006 Kawanobe et al. ..... 49/26
7,205,734 B2 * 4/2007 Kidokoro ..... 318/268
7,288,907 B2 * 10/2007 Kamiya et al. ..... 318/266
7,406,377 B2 * 7/2008 Shiga ..... 701/49
7,472,944 B2 * 1/2009 Miyagawa et al. ..... 296/155
2003/0116995 A1 * 6/2003 Yogo et al. ..... 296/155
2005/0160674 A1 * 7/2005 Noro et al. ..... 49/360

(Continued)

FOREIGN PATENT DOCUMENTS

JP 11-236783 A 8/1999

(Continued)

*Primary Examiner*—Jerry Redman
(74) *Attorney, Agent, or Firm*—Foley & Lardner LLP

(57) ABSTRACT

A control device controls opening/closing of a sliding door of a vehicle by a motor in cooperation with a drive device that opens and closes the sliding door, and applies proportional plus integral plus differential control to motor speed based on a driving pattern of the sliding door. When a difference between a door speed and a motor speed exceeds a threshold, the control device judges that the vehicle is parked in a tilted state, and adjusts a sum of a proportional element, an integral element, and a differential element of a proportional plus integral plus differential control to a vehicle-tilted time element.

3 Claims, 6 Drawing Sheets

TARGET SPEED : Vn
PRESENT MOTOR SPEED : Vm0
LAST MOTOR SPEED : Vm1
MOTOR SPEED BEFORE LAST : Vm2

LAST DEVIATION : Hen1=Vn-Vm1
DEVIATION BEFORE LAST : Hen2=Vn-Vm2
PRESENT DEVIATION : Hen0=Vn-Vm0

Kp : PROPORTIONAL RESPONSIVENESS GAIN
Ki : INTEGRAL RESPONSIVENESS GAIN
Kd : DIFFERENTIAL (DEVIATION) RESPONSIVENESS GAIN

Gain = Kp(Hen0-Hen1) + Ki(Hen0) + Kd{(Hen0-Hen1)-(Hen1-Hen2)}

U.S. PATENT DOCUMENTS

2006/0107598 A1* 5/2006 Imai et al. ..... 49/360
2006/0150515 A1* 7/2006 Shiga ..... 49/360
2006/0156630 A1* 7/2006 Yokomori et al. ..... 49/360
2006/0202507 A1* 9/2006 Miyagawa et al. ..... 296/155
2007/0096504 A1* 5/2007 Kothe et al. ..... 296/155
2007/0246902 A1* 10/2007 Trudeau et al. ..... 280/6.16
2008/0150319 A1* 6/2008 Ray ..... 296/146.1

FOREIGN PATENT DOCUMENTS

JP 2003-143882 A 5/2003
JP 2003-182368 A 7/2003

* cited by examiner

DOOR OPENING/CLOSING CONTROL DEVICE

BACKGROUND OF THE INVENTION

1. Field of the Invention

The present invention relates to a device that controls opening and closing of a sliding door of a vehicle.

2. Description of the Related Art

A door opening/closing device is used to drive a sliding door of a vehicle. Moreover, a door opening/closing control device is used to control the sliding door in cooperation with the door opening/closing device.

The door opening/closing device includes a motor, a clutch, and a wire drum. The torque of the motor is transmitted to the wire drum via the clutch. Therefore, when the clutch is brought into a coupled state, motor torque is conveyed to the wire drum. When the clutch is brought into an uncoupled state, motor torque it not conveyed to the wire drum. The wire drum rotates to wind a wire cable from one side thereof and pulls out the wire cable from the other side to open and close the sliding door. A moving direction of the sliding door depends on a rotating direction of the wire drum.

The door opening/closing device includes a tension mechanism that applies tension to the wire cable. Moreover, clearance is provided in the clutch. The tension mechanism and the clearance in the clutch prevent the wire cable from slackening. On the other hand, when the vehicle is parked in a tilted state, particularly, when the front part of the vehicle is lower than the back part, the tension mechanism and the clearance in the clutch function as play so that the sliding door moves and pulsates, irrespective of the control the door opening/closing device, because of the dead weight of the sliding door. This phenomenon is hereafter referred to as hunting. There is a need for a door opening/closing control device that prevents such hunting.

Some door opening/closing control devices monitor current supplied to the motor, which is performing pulse width modulation (PWM) driving, and, when the current exceeds a predetermined value, judge that a foreign matter has been pinched in the sliding door and reverses the sliding door.

Japanese Patent Application Laid-Open No. H11-236783, for example, discloses an opening/closing control device that calculates a tilt angle of the vehicle and performs opening/closing control of the sliding door based on the tilt angle. The tilt angle is calculated based on a duty ratio of a motor, which is performing PWM driving. However, this opening/closing control device does not address the problem of hunting of the sliding door.

Moreover, the opening/closing control device disclosed in Japanese Patent Application Laid-Open No. H12-236783 erroneously judges that a foreign matter is pinched in the sliding door when the sliding door is not moving, even when there is no foreign matter pinched. Accordingly, the conventional opening/closing control device cannot sensitively judge whether a foreign matter is pinched.

Furthermore, there is a need to control the sliding door to open/close smoothly and gently when the vehicle is parked in a tilted state.

SUMMARY OF THE INVENTION

It is an object of the present invention to at least solve the problems in the conventional technology.

According to an aspect of the present invention, a control device for controlling opening/closing of a sliding door of a vehicle by a motor in cooperation with a drive device that opens and closes the sliding door, includes a detecting unit that detects door speed of the sliding door, an applying unit that applies, based on a driving pattern of the sliding door set in advance, proportional plus integral plus differential control to motor speed of the motor, a tilt-judging unit that judges, when a difference between the door speed and the motor speed exceeds a threshold within a predetermined time from when the sliding door starts to open/close, that the vehicle is parked in a tilted state, and an adjusting unit that adjusts a sum of a proportional element, an integral element, and a differential element of the proportional plus integral plus differential control to a vehicle-tilted time element.

According to another aspect of the present invention, a control device for controlling opening/closing of a sliding door of a vehicle by a motor in cooperation with a drive device that opens and closes the sliding door includes a detecting unit that detects door speed of the sliding door, an applying unit that applies, based on a driving pattern of the sliding door set in advance, feedback control to motor speed of the motor, a tilt-judging unit that judges, when a difference between the door speed and the motor speed exceeds a threshold within a predetermined time from when the sliding door starts to close, that the vehicle is parked in a tilted state, and an adjusting unit that brings forward a deceleration start timing of the driving pattern.

According to still another aspect of the present invention, a control device for controlling opening/closing of a sliding door of a vehicle by a motor in cooperation with a drive device that opens and closes the sliding door. includes a detecting unit that detects door speed of the sliding door, an applying unit that applies, based on a driving pattern of the sliding door set in advance, feedback control to motor speed of the motor, a tilt-judging unit that judges, when the sliding door closes from a half-opened state, that the vehicle is parked in a tilted state, regardless of whether the vehicle is actually tilted, and an adjusting unit that brings forward a deceleration start timing of the driving pattern.

According to still another aspect of the present invention, a control device for controlling opening/closing of a sliding door of a vehicle by a motor in cooperation with a drive device that opens and closes the sliding door, includes a detecting unit that detects door speed of the sliding door, an applying unit that applies, based on a driving pattern of the sliding door set in advance, feedback control to motor speed of the motor, a tilt-judging unit that judges, when a difference between the door speed and the motor speed exceeds a threshold within a predetermined time from when the sliding door starts to open, that the vehicle is parked in a tilted state, and an adjusting unit that delays an acceleration start timing of the driving pattern.

According to still another aspect of the present invention, a control device for controlling opening/closing of a door of a vehicle by a motor in cooperation with a drive device that opens and closes the door includes a detecting unit that detects door speed of the door, an applying unit that applies, based on a driving pattern of the door set in advance, feedback control to motor speed of the motor, a follow-up judging unit that judges, when a difference between the door speed and the motor speed exceeds a threshold after elapse of a predetermined time from when the door starts to open/close, that the door is subjected to a follow-up operation.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 1:
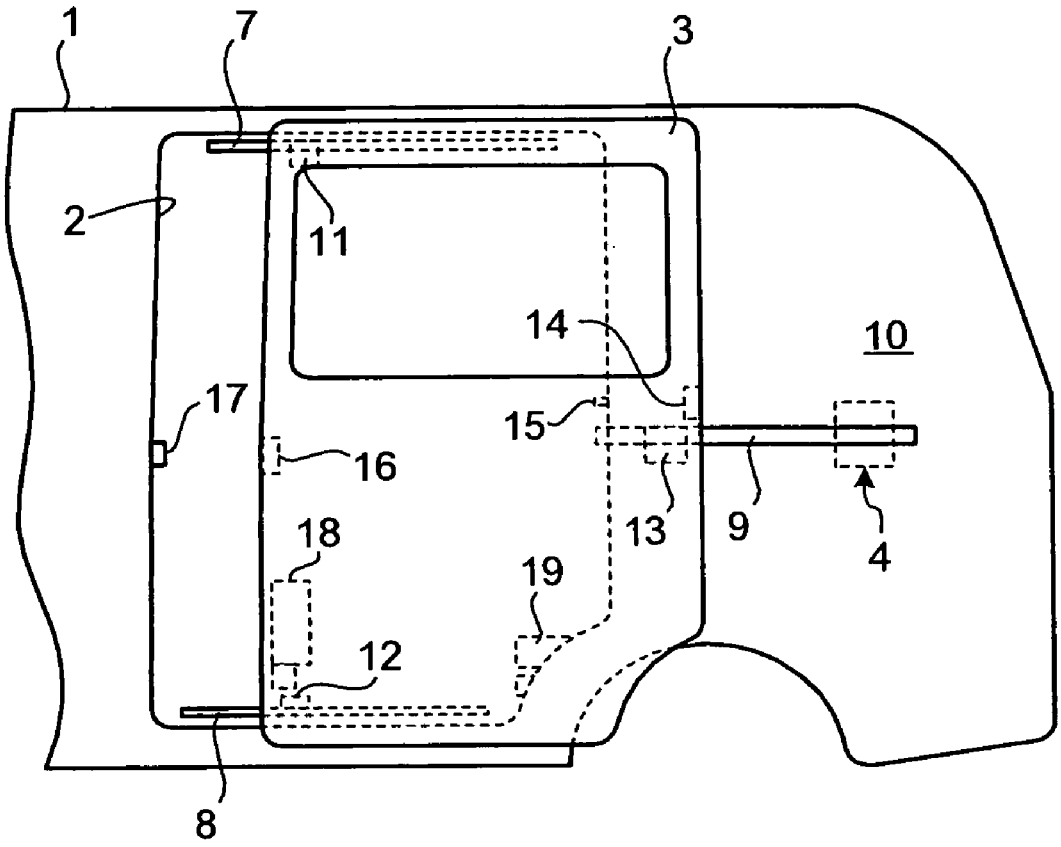
FIG. 1 is a diagram of a sliding door to which a door opening/closing control device according to the present invention is applied.

FIG. 1 is a diagram of a sliding door 3 to which a door opening/closing control device according to the present invention is applied.

The door opening/closing control device controls a door opening/closing device 4 and the sliding door 3, so as to open and close an opening 2 on a side of a vehicle body 1.

The sliding door 3 is supported by an upper rail 7, a lower rail 8, and a center rail 9. The upper rail 7 is attached to an upper edge of the opening 2. The lower rail 8 is attached to a lower edge of the opening 2. The center rail 9 is attached to a side of a quarter panel 10 that is a rear portion of the vehicle body 1. Note that the upper rail 7, the lower rail 8, and the center rail 9 curve largely into a cabin of the vehicle body 1, immediately before a closing position of the sliding door 3.

An upper bracket 11, a lower bracket 12, and a center bracket 13 are attached to the sliding door 3. The upper bracket 11 is attached to a front upper edge of the sliding door 3 and engages with the upper rail 7 to slide freely. The lower bracket 12 is attached to a front lower edge of the sliding door 3 and engages with the lower rail 8 to slide freely. The center bracket 13 is attached in the rear center of the sliding door 3, on a side facing the cabin, and engages with the center rail 9. Accordingly, the sliding door 3 slides freely towards the front and the back of the vehicle body 1 so as to open and close the opening 2.

A latch device 14 is attached in the rear center of the sliding door 3. A striker 15 is attached to a rear edge of the opening 2. The latch device 14 becomes a half-latch state for temporarily holding the sliding door 3 immediately before a fully-closed state, and becomes a full-latch state for holding the sliding door 3 in the fully-closed state. When the sliding door 3 is fully closed, the latch device 14 and the striker 15 engage with each other to maintain the closed state. Note that a latch device 16 can be attached in the front center of the sliding door 3 and a striker 17 can be attached to a front edge of the opening 2.

The latch devices 14 and 16 include a closer device (not shown) that brings the strikers 15 and 17 into a full latch state when a half latch state is detected in closing the sliding door 3. Moreover, the latch devices 14 and 16 include a release device (not shown) including a solenoid for bringing the strikers 15 and 17 into an unlatch state for releasing the sliding door 3 from the full latch state in opening the sliding door 3.

A full-open holder 18 is attached to a front lower part of the sliding door 3. A full-open striker 19 is attached to a lower rear edge of the opening 2. Accordingly, when the sliding door 3 is fully opened, the full-open holder 18 and the full-open striker 19 engage with each other to maintain the fully-opened state.

Figure 2:
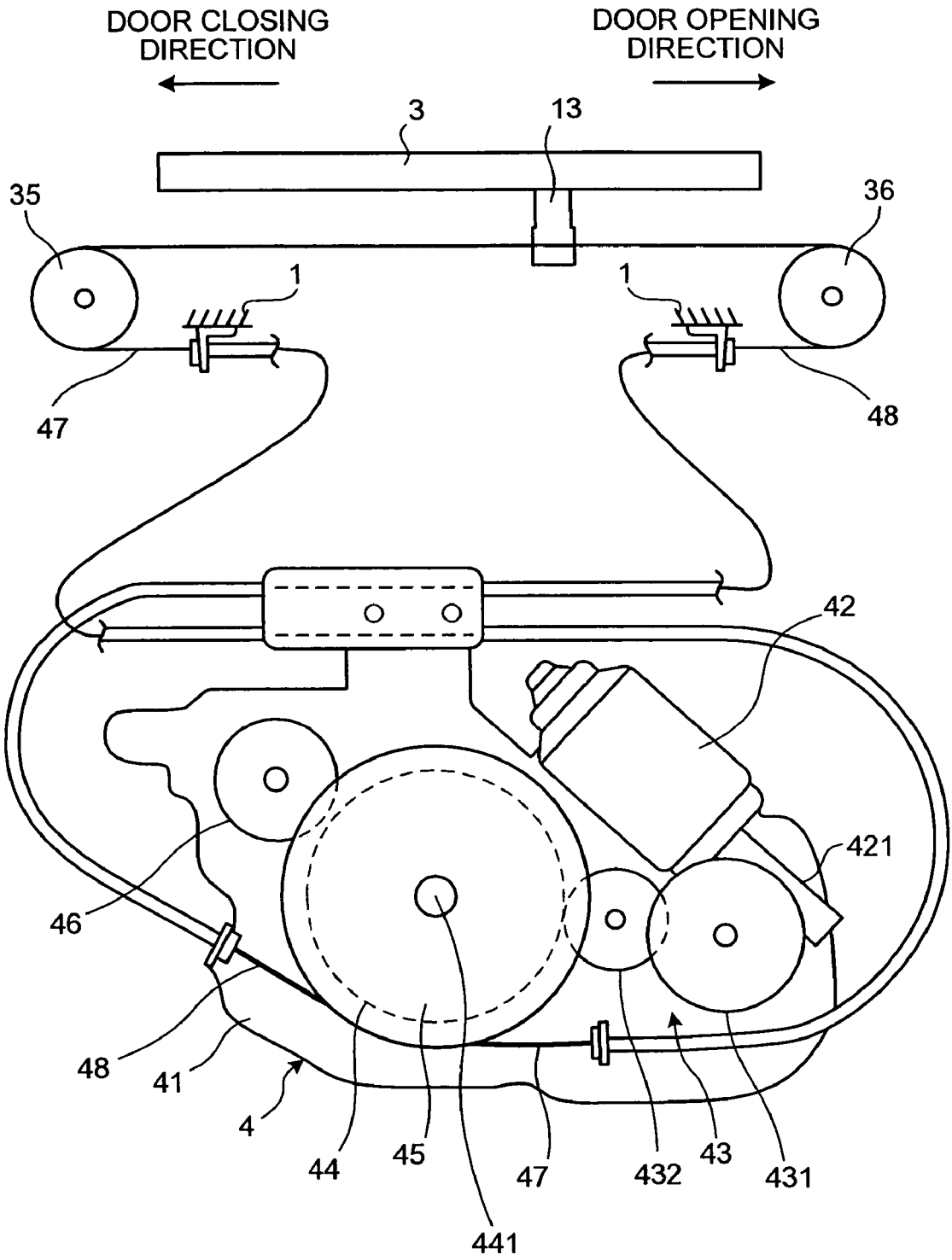
FIG. 2 a detailed schematic of a door opening/closing device shown in FIG. 1.

FIG. 2 is a detailed schematic of the door opening/closing device 4 shown in FIG. 1. The door opening/closing device 4 opens and closes the sliding door 3, and is disposed in an inner space of the quarter panel 10. The door opening/closing device 4 has a base plate 41, a driving motor 42, a decelerating mechanism 43, a clutch 44, a wire drum 45, and an electromagnetic brake 46 and is fixed to the vehicle body 1 via the base plate 41.

The driving motor 42 is fixed to the base plate 41 sideways. A worm gear 421 is provided in an output shaft (not shown) of the driving motor 42.

The deceleration mechanism 43 includes a plurality of deceleration gears 431, 432 that mesh with each other. The deceleration gear 431 on an input side of the deceleration mechanism 43 is meshed with the worm gear 421 of the driving motor 42.

The clutch 44 includes a clutch shaft 441. A gear (not shown) provided in the clutch shaft 441 is meshed with the deceleration gear 432 on an output side of the deceleration mechanism 43. Rotation of the driving motor 42 is transmitted to the clutch shaft 441 of the clutch 44 via the deceleration mechanism 43. The clutch 44 in this embodiment is an electromagnetic clutch and is able to freely switch to and from a coupled state and an uncoupled state electrically. Therefore, it is possible to arbitrarily transmit rotation of the driving motor 42, which is transmitted to the clutch shaft 441, to a driving system in a later stage from the clutch shaft 441.

The wire drum 45 is rotatably arranged around the clutch shaft 441. The wire drum 45 is constituted as the driving system in a later stage of the clutch shaft 441. The deceleration mechanism 43 and the wire drum 45 are freely switched into the coupled state and the uncoupled state electrically by the clutch 44. One end of two wire cables 47 and 48 are wound around the wire drum 45. The other end of the wire cable 47 is coupled to the bracket 13, which extends from the sliding door 3 through a front side pulley 35 pivotally supported to be rotatable on the vehicle body 1 side. The other end of the wire cable 48 is coupled to the bracket 13 through a rear side pulley 36 pivotally supported to be rotatable on a side of the vehicle body 1.

The electromagnetic brake 46 is actuated by electrical control to apply braking to the wire drum 45.

In the door opening/closing control device 4 described above, by driving the driving motor 42, the wire drum 45 rotates around the clutch shaft 441 via the deceleration mechanism 43 and the clutch 44 that is in the coupled state. When the wire drum 45 rotates clockwise in FIG. 2, one wire cable 47 is wound by the wire drum 45 and the other wire cable 48 is pulled out from the wire drum 45. Thus, the sliding door 3 moves in a direction toward to the front side pulley 35 to close the opening 2. Conversely, when the wire drum 45 rotates counterclockwise, one wire cable 47 is pulled out from the wire drum 45 and the other wire cable 48 is wound by the wire drum 45. As a result, the sliding door 3 moves in a direction toward the rear side pulley 36 to open the opening 2.

Figure 3:
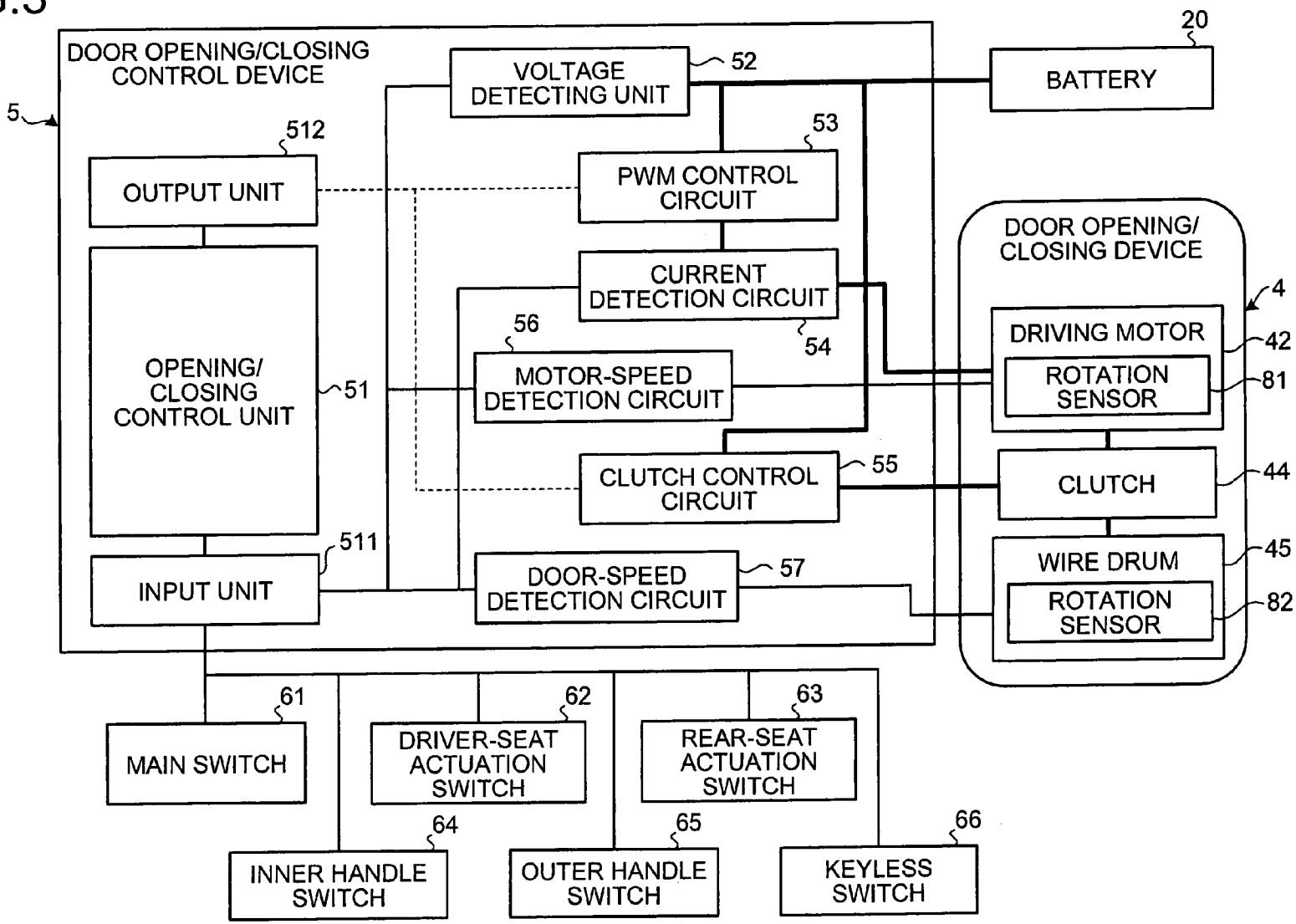
FIG. 3 is a block diagram of a door opening/closing device and a door opening/closing control device.

FIG. 3 is a block diagram of the door opening/closing device 4 and a door opening/closing control device 5. The door opening/closing control device 5 shown in FIG. 3 includes an opening/closing control unit 51 for collectively controlling the door opening/closing control device 5 according to data and a program stored therein in advance. A voltage detecting unit 52, a PWM control circuit 53, a current detection circuit 54, and a clutch control circuit 55 are connected to the opening/closing control unit 51 as a power supply system. The voltage detecting unit 512 and the current detection circuit 54 are connected to the opening/closing control unit 51 via an input unit 511. The PWM control circuit 53 and the clutch control circuit 55 are connected to the opening/closing control unit 51 via an output unit 512. A motor-speed detection circuit 56 and a door-speed detection circuit 57 are also connected to the opening/closing control unit 51 as a detection system via the input unit 511. Moreover, a main switch 61, a driver-seat actuation switch 62, a rear-seat actuation switch 63, an inner handle switch 64, an outer handle switch 65, and a keyless switch 66 are also connected to the opening/closing control unit 51 as a group of switches via the input unit 511.

The voltage detecting unit 52 is a unit for detecting a voltage at a battery 20 mounted on the vehicle body 1. The voltage detected by the voltage detecting unit 52 is input to the opening/closing control unit 51 via the input unit 511. The voltage at the battery 20 is supplied from the PWM control circuit 53 to the driving motor 32 through the current detection circuit 54. Moreover, the voltage at the battery 20 is supplied to the clutch 44 through the clutch control circuit 55.

The PWM control circuit 53 controls a voltage supplied to the driving motor 42. Motor rotational speed of the driving motor 42, that is, moving speed of the sliding door 3 is changed by changing application time of a voltage.

The current detection circuit 54 is a circuit for detecting a current value applied to the driving motor 42. Note that adjustment of an output of the driving motor 42 by the PWM control circuit 53 is performed through adjustment of voltage application time (DUTY control) in one cycle (e.g., 2000 Hz). At the time of a maximum output, since a DUTY ratio is 100%, a voltage waveform is that of a DC voltage. Thus, it is possible to directly measure an actual load current value of the driving motor 42 in the current detection circuit 54. On the other hand, since a DUTY ratio in an acceleration area and a deceleration area is less than 100%, a waveform of an applied voltage appears in pulse. Thus, the driving motor 42 is substantially alternate current (AC) driven. In this AC driven area, since a current value fluctuates continuously, it is necessary to level the current value. Thus, the current detection circuit 54 multiplies an AC current value by a predetermined correction coefficient to obtain a corrected current value based on an actual load of the driving motor 42.

The clutch control circuit 55 is a circuit for supplying a voltage from the battery 20 to the clutch 44 and instructing driving of the clutch 44.

The motor-speed detection circuit 56 is a circuit for obtaining a signal from a rotation sensor 81 disposed in the driving motor 42 and mainly detecting rotational speed of the motor. The rotation sensor 81 is provided over a rotation shaft, to which rotation of the output shaft of the driving motor 42 is transmitted without being decelerated, such as a rotation shaft to which the deceleration gear 431 on the input side meshing with the worm gear 421 is fixed. The rotation sensor 81 includes a permanent magnet of a disc shape, which is provided to be rotatable with the rotation shaft, and two hall elements (hall ICs) for detecting rotation of the permanent magnetic disc. The hall element detects rotation of the permanent magnet disc and outputs a pulse signal. The motor-speed detection circuit 56 is capable of detecting rotation speed of the driving motor 42 by obtaining a pulse signal.

The door-speed detection circuit 57 receives a signal from a rotation sensor 82 arranged in the wire drum 45 to mainly detect moving speed of the sliding door 3. The rotation sensor 82 is provided on a rotation shaft to which rotation of the wire drum 45 is transmitted without being decelerated. The rotation sensor 82 includes a permanent magnet disc (not shown) so as to rotate with the rotation shaft and two hall ICs (not shown). The respective two hall ICs detect rotation of the permanent magnet disc and outputs pulse signals of phases different from each other. The door-speed detection circuit 57 is capable of detecting rotation speed and a rotation direction of the drum by obtaining different pulse signals. In other words, the door-speed detection circuit 57 can detect the speed and the direction of movement of the sliding door 3. The door-speed detection circuit 57 can output the pulse signals obtained to the opening/closing control unit 51 via the input unit 511.

The main switch 61 is a switch for enabling opening/closing control of the door opening/closing device 4. Only when the main switch 61 is in an ON state, the door opening/closing device 4 can perform the opening/closing control. Therefore, when the main switch 61 is in an OFF state, the sliding door 3 is opened and closed manually. The other switches (the driver-seat actuation switch 62, the rear-seat actuation switch 63, the inner handle switch 64, the outer handle switch 65, and the keyless switch 66) output operation inputs from a user to the door opening/closing control device 5. Each of the switches has an operation button (not shown) for operating the opening/closing of the sliding door 3.

Figure 4:
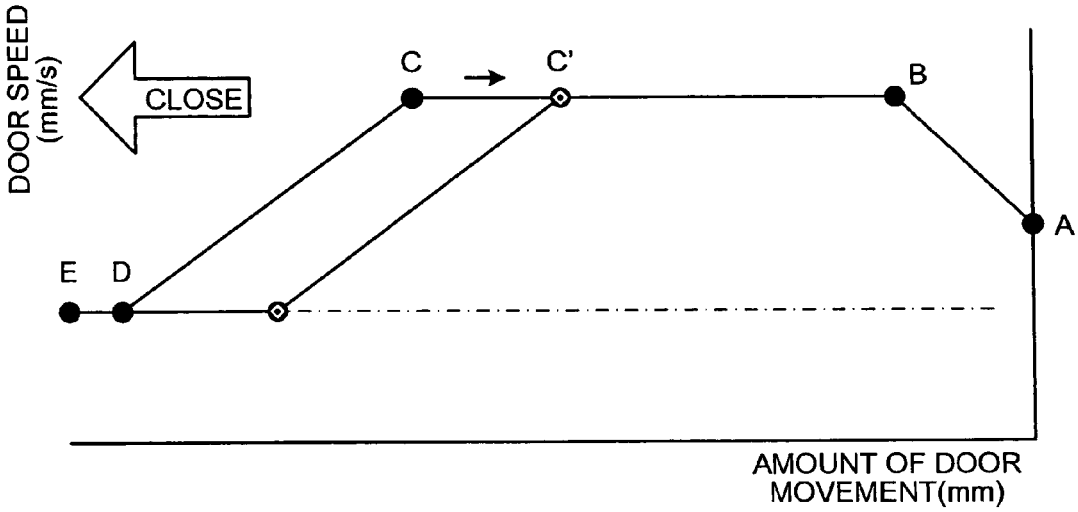
FIG. 4 is a speed diagram of a closing pattern of the sliding door.
Figure 5:
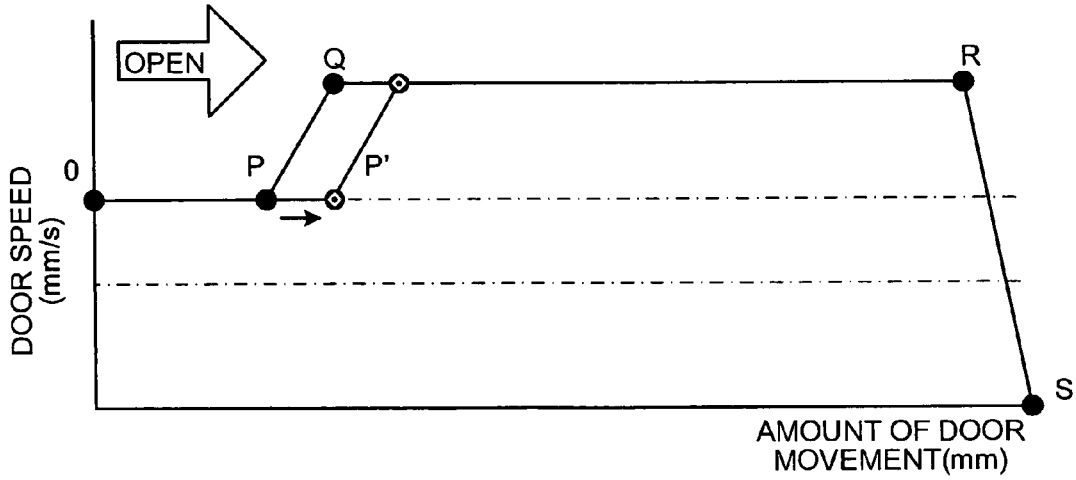
FIG. 5 is a speed diagram of an opening pattern of the sliding door.

Driving patterns for the sliding door 3 are stored in the opening/closing control unit 51 in advance. The driving patterns include a door closing pattern and a door opening pattern. FIG. 4 is a speed diagram of the door closing pattern of the sliding door 3. FIG. 5 is a speed diagram of the door opening pattern for the sliding door 3.

As shown in FIG. 4, the door closing pattern is a pattern defining an amount of movement of the sliding door 3 from a fully-opened position A to a fully-closed position (D-E) in association with speed. Specifically, the sliding door 3 is accelerated from the fully-opened position A (A to B), closed at high speed (uniform speed) (B to C), and decelerated (C to D) to reach the fully-closed position (D to E). In the door closing pattern, timing C at which deceleration starts is referred to as deceleration start timing C.

The door opening pattern is a pattern defining an amount of movement of the sliding door 3 from a fully-closed position O to a fully-opened position (R to S) in association with speed. Specifically, the sliding door 3 is actuated at low speed from the fully-closed position O (O to P) and accelerated (P to Q) to be operated at high speed (uniform speed) (Q to R). Thereafter, the sliding door 3 is decelerated to reach the fully-opened position (R to S). In the door opening pattern, timing P at which acceleration starts is referred to as acceleration start timing P.

Figure 6:
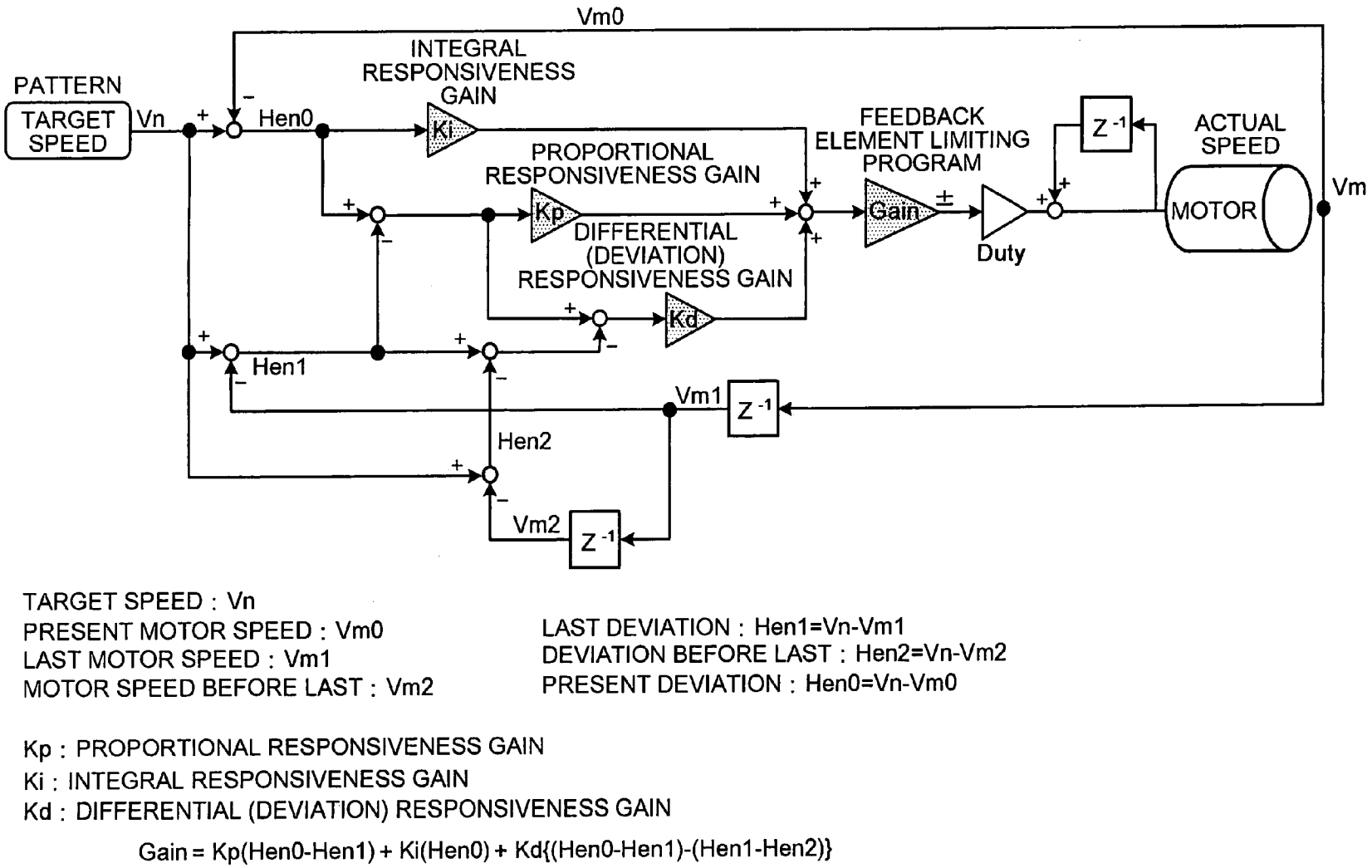
FIG. 6 is a block diagram for explaining a door opening and closing program.
Figure 7:
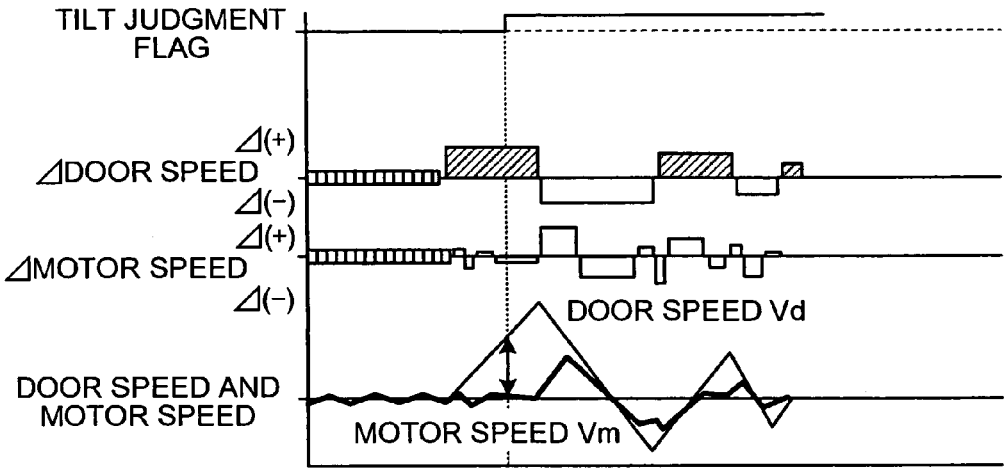
FIG. 7 is a time chart for explaining a tilt judgment program.

Driving programs such as a door-position detecting program, a door opening program, a door closing program, a tilt judging program, a tile-judgment canceling program, a follow-up operation judging program, a follow-up operation cancellation judging program, and a pinch judging program are stored in the opening/closing control unit 51. FIG. 6 is a block diagram for explaining the door opening program. FIG. 7 is a time chart for explaining the tilt judging program. FIG.

8 is a time chart for explaining the follow-up operation judging program, the follow-up operation cancellation judging program, and the pinch judging program.

The door-position detecting program is a program for detecting a position of the sliding door 3 by counting pulse signals inputted from the door-speed detection circuit 57 via the input unit 511. Taking into account aged deterioration (stretch) of the wire cables 47 and 48, pulse signals are initialized (a pulse count initial value =0) in the fully-closed position of the sliding door 3 every time the sliding door 3 is opened and then closed.

The door opening program is a program for opening the sliding door 3 according to the door opening pattern stored in advance. The door opening program is defined to perform feedback control according to the door opening pattern. The feedback control is proportional plus integral plus differential (PID) control. The door opening program controls the PWM control circuit 53 such that door speed detected by the door-speed detection circuit 57 coincides with the door opening pattern.

The door opening program is explained more specifically with reference to FIG. 6.

First, the door opening program calculates, based on the door opening pattern, target speed Vn of the driving motor 42 from door speed associated with an amount of door movement. The door opening program sets a difference value (Vn−Vm) between the target speed Vn and actual speed Vm of the driving motor 42 acquired from the motor-speed detection circuit 56 as present deviation Hen0.

The door opening program calculates, as a feedback element, a sum (Ki(Hen0)+Kp(Hen0−Hen1+Kd{(Hen0−Hen1)−(Hen1−Hen2)})) of an integral element (Ki(Hen0)) calculated by multiplying the present deviation Hen0 by an integral gain Ki, a proportional element (Kp(Hen0−Hen1)) calculated by multiplying a difference value (Hen0−Hen1) between the present deviation Hen0 and the last deviation Hen1 by a proportional gain Kp, and a differential element (Kd{(Hen0−Hen1)−(Hen1−Hen2)}) calculated by multiplying a value, which is calculated by subtracting a difference value (Hen1−Hen2) between the last deviation and deviation before last from the difference value (Hen0−Hen1) between the present deviation and the last deviation, by a differential (deviation) gain Kd.

The feedback element calculated in this way undergoes a feedback element limiting program and is converted into a Duty ratio and added to the last control amount ($Z^{-1}$). As a result, a control amount (a Duty ratio in the PWM control circuit 53) is calculated. Note that, in a usual state, the feedback element limiting program is disabled. The present control amount is calculated by adding the last control amount ($Z^{-1}$) to the feedback element calculated.

The door closing program is a program for closing the sliding door 3 according to the door closing pattern stored in advance. The door closing program is defined to perform feedback control according to the door closing pattern. The feedback control is also the PID control. The door closing program controls the PWM control circuit 53 such that door speed detected by the door-speed detection circuit 57 coincides with the door closing pattern.

As shown in FIG. 7, the tilt judging program is a program for performing tilt judgment based on motor speed Vm detected by the motor-speed detection circuit 56 and door speed Vd detected by the door-speed detection circuit 57. When a speed difference Vd−Vm between the door speed Vd and the motor speed Vm exceeds a speed difference set in advance within a predetermined time from start of opening and closing operation for the sliding door 3, the tilt judging program judges that a vehicle is parked in a tilted state.

Specifically, in closing the sliding door 3, when the door speed Vd increases ahead of the motor speed Vm and the speed difference Vd−Vm between the door speed Vd and the motor speed Vm exceeds the speed difference set in advance, the tilt judging program judges that the vehicle is parked in a down forward state. In opening the sliding door 3, when the door speed Vd increases ahead of the motor speed Vm and the speed difference Vd−Vm between the door speed Vd and the motor speed Vm exceeds the speed difference set in advance, the tilt judging program judges that the vehicle is parked in an up forward state. In other words, the tilt judging program judges that the vehicle is parked in a tilted downward state in the moving direction of the sliding door 3.

When it is judged that the vehicle is parked in a tilted state, a tilt judgment flag is set ON. When the tilt judgment flag is ON, the feedback element in the PID control of the door opening program and the door closing program is adjusted to a vehicle tilted time element in the feedback element limiting program. The vehicle tilted time element is an element obtained by limiting a sum of a proportional element, an integral element, and a differential element. The sum of the proportional element, the integral element, and the differential element is limited to be adjusted to the vehicle tilted time element by enabling the feedback element limiting program. Therefore, a control amount (a Duty ratio in the PWM control circuit 53) is limited to allow door speed to converge to target speed at an early stage.

The tilt-judgment canceling program is a program for calculating a hunting judgment position after elapse of a predetermined time from when it is judged that the vehicle is parked in a tilted state and, when the sliding door 3 does not reach the hunting judgment position after the elapse of the predetermined time, canceling tilt judgment and canceling the adjustment of the feedback element.

The hunting judgment position is a position for judging whether the sliding door 3 is subjected to hunting. A door reaching position where hunting does not occur even if a position of the sliding door 3 is ahead of a door reaching position, calculated based on target speed and a predetermined time, is set as the hunting judgment position.

The cancellation of the tilt judgment means that the tilt judgment flag is set OFF. The adjustment of the feedback element is canceled by setting the tilt flag OFF. The feedback control program is disabled. Subsequently, the driving motor 42 is driven according to the present control amount calculated by adding the last control amount ($Z^{-1}$) to the feedback element.

In closing the sliding door 3, when the tilt judgment flag is set ON, the vehicle is parked in a down forward state. Thus, as shown in FIG. 4, the tilt-judgment canceling program brings forward deceleration start timing for the door closing pattern (moves the declaration start timing from C to C').

In closing the sliding door 3 in a half-opened state, regardless of whether the vehicle is actually tilted, the tilt-judgment canceling program judges that the vehicle is parked in a tilted state and brings forward the deceleration start timing C of the door closing pattern (moves the deceleration start timing from C to C').

On the other hand, in opening the sliding door 3, when the tilt judgment flag is set ON, the vehicle is parked in an up forward state. Thus, as shown in FIG. 5, the tilt-judgment canceling program delays the acceleration start timing P of the door opening pattern (moves the acceleration start timing from P to P').

Figure 8:
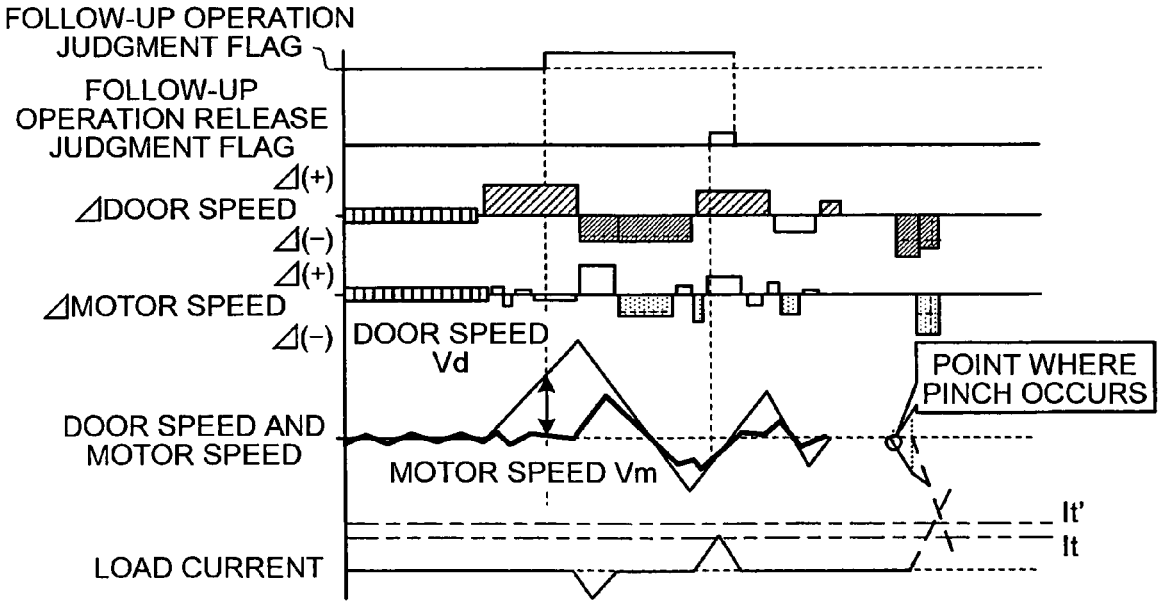
FIG. 8 is a time chart for explaining a follow-up operation judgment program, a follow-up operation cancellation judgment program, and a pinch judgment program.

As shown in FIG. 8, the follow-up operation judging program performs follow-up operation judgment based on the motor speed Vm detected by the motor-speed detection circuit 56 and the door speed Vd detected by the door-speed detection circuit 57 in the same manner as the tilt judging program. When the speed difference Vd−Vm between the door speed Vd and the motor speed Vm exceeds the speed difference set in advance after elapse of a predetermined time from start of opening/closing operation of the sliding door 3, the follow-up operation judging program judges that follow-up operation is performed. Note that the follow-up operation means that supplementary operation is performed in the moving direction of the sliding door 3 by a passenger or the like during an operation of the door opening/closing device 4.

When it is judged that the follow-up operation is complete, the follow-up operation judging program sets a follow-up operation judgment flag in an ON state.

The follow-up operation cancellation judging program is enabled when the follow-up operation judgment flag is ON. The follow-up operation cancellation judging program is not enabled when the follow-up operation judgment flag is OFF.

The follow-up operation cancellation judging program performs follow-up operation cancellation judgment based on the motor speed Vm detected by the motor-speed detection circuit 56, the door speed Vd detected by the door-speed detection circuit 57, and a motor speed increase. When the follow-up operation judgment flag is ON, the follow-up operation cancellation judging program judges that follow-up operation for the sliding door 3 is canceled when the speed difference between the door speed Vd increased after being decreased and the motor speed Vm converge to the speed difference set in advance, and a door speed increase exceeds a predetermined amount set in advance. Note that the follow-up operation cancellation means that the follow-up operation is suspended.

When it is judged that the follow-up operation is canceled in this way, the follow-up operation cancellation judging program sets the follow-up operation cancellation judgment flag ON for a predetermined time.

The pinch judging program judges whether a hand, a foot, or the like of a passenger is pinched between the vehicle body 1 and the sliding door 3. As shown in FIG. 8, the pinch judging program judges whether something is pinched by monitoring a load current (a corrected current) outputted from the current detection circuit 54. When a load current exceeding a judgment value It set in advance is detected, the pinch judging program judges that something is pinched.

When follow-up operation by the passenger or the like is canceled, similarly to when pinch occurs, the load current increases. Thus, when the judgment value It is set low, the pinch judging program might judge the cancellation of the follow-up operation as pinch. On the other hand, when the judgment value It is set high, unless a large force is applied, the pinch judging program cannot judge that pinch has occurred.

Thus, when the follow-up operation cancellation judgment flag is set ON, the judgment value It of the pinch judging program is alleviated for a predetermined time. Specifically, the judgment value It of the load current used for the pinch judgment is changed to a judgment value It' higher than the judgment value It, so as to alleviate the judgment value It.

When the pinch judging program judges that pinch has occurred, the door opening/closing control device 5 reverses a rotating direction of the driving motor 42, switches a moving direction of the sliding door 3 to an opposite direction, and moves the sliding door 3 by a predetermined amount. Specifically, when the sliding door 3 is moving in the closing direction, the door opening/closing control device 5 moves the sliding door 3 in the opening direction by the predetermined amount. When the sliding door 3 is moving in the opening direction, the door opening/closing control device 5 moves the sliding door 3 in the closing direction by the predetermined amount.

The door opening/closing control device 5 in the embodiment described above judges, when a speed difference between door speed and motor speed exceeds the speed difference set in advance, that the vehicle is parked in a tilted state, and limits a sum of a proportional element, an integral element, and a differential element of the PID control. This allows the door speed to converge to target speed at an early stage.

When the sliding door 3 does not reach the hunting judgment position after elapse of a predetermined time from when it is judged that the vehicle is parked in a tilted state, the door opening/closing control device 5 judges that hunting has converged and cancels tilt judgment. As a result, it is possible to subject the driving motor 42 to the PID control based on the driving pattern set in advance.

When it is judged that the vehicle is parked in a down forward state, the door opening/closing control device 5 brings forward the deceleration start timing of the closing pattern set in advance and reduces door speed of the sliding door 3 in the curved portion immediately before the position where the sliding door 3 is completely closed. This makes it possible to control hunting of the sliding door 3.

In closing the sliding door 3 in the half-opened state, regardless of whether the vehicle is parked in a tilted state, the door opening/closing control device 5 judges that the vehicle is parked in a tilted state, brings forward the deceleration start timing of the door closing pattern, and reduces door speed of the sliding door 3 in the curved portion immediately before the position where the sliding door 3 is completely closed. This makes it possible to control hunting of the sliding door 3.

When it is judged that the vehicle is parked in an up forward state, the door opening/closing control device 5 delays the acceleration start timing P of the opening pattern set in advance and reduces door speed of the sliding door 3 in the curved portion in the position where the sliding door 3 starts to be opened. This makes it possible to control hunting of the sliding door 3.

When a speed difference between door speed and motor speed exceeds the speed difference set in advance after elapse of a predetermined time from start of opening and closing operation of the sliding door 3, the follow-up operation judging program judges that the sliding door 3 is subjected to follow-up operation. Thereafter, when a speed difference between the door speed increased after being decreased and the motor speed converges to a speed difference within the speed difference set in advance and a door speed increase exceeds the predetermined amount set in advance, the follow-up operation canceling program judges that the follow-up operation for the sliding door 3 is canceled and alleviates a pinch judgment value for the sliding door. As a result, even if the judgment value It is alleviated to judge pinch sensitively, it is possible to prevent misjudgment of pinch.

According to the present invention, door speed can converge to target speed at an early stage.

Furthermore, according to the present invention, it is possible to apply a PID control to a motor based on a driving pattern set in advance.

Moreover, according to the present invention, it is possible to reduce door speed of a sliding door immediately before completely closing the sliding door and control hunting of the sliding door.

Furthermore, according to the present invention, it is possible to reduce door speed of a sliding door at the start of opening of the sliding door and control hunting of the sliding door.

Moreover, according to the present invention, it is possible to prevent misjudgment on pinch of a foreign matter in a sliding door.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

This application claims priority from Japanese Patent Application 2004-379881, filed Dec. 28, 2004, which is incorporated herein by reference in its entirety.

What is claimed is:

1. A control device for controlling opening/closing of a sliding door of a vehicle by a motor in cooperation with a drive device that opens and closes the sliding door, comprising:

a detecting unit that detects door speed of the sliding door;

an applying unit that controls a speed of the sliding door, based on a control pattern of the sliding door set in advance, by controlling a speed of the motor with proportional-integral-derivative control;

a tilt-judging unit that judges, when a difference between the door speed and the motor speed exceeds a threshold within a first predetermined time from when the sliding door starts to open/close, that the vehicle is parked in a tilted state; and an adjusting unit that adjusts a sum of a proportional element, an integral element, and a derivative element of the proportional-integral-derivative control to a vehicle-tilted time element.

2. The control device according to claim 1, wherein the vehicle-tilted time element limits the sum of the proportional element, the integral element, and the derivative element.

3. The control device according to claim 1, further comprising:

a calculating unit that calculates a hunting judgment position after elapse of a second predetermined time from when the tilt-judging unit judges that the vehicle is parked in a tilted state, wherein when the sliding door does not reach the hunting judgment position after the elapse of the second predetermined time, the tilt-judging unit does not perform judgment of whether the vehicle is parked in a tilted state and the adjusting unit does not perform adjustment of the vehicle-tilted time element.

* * * * *